United States Patent [19]

Bagalini et al.

[11] 3,950,715

[45] Apr. 13, 1976

[54] CIRCUIT BREAKER WITH IMPROVED TRIP MEANS

[75] Inventors: Dante Bagalini, Johannesburg; Alexander Towianski, New Redruth, both of South Africa

[73] Assignee: Fuchs Electrical Industries, Transvaal, South Africa

[22] Filed: Oct. 29, 1974

[21] Appl. No.: 518,913

[52] U.S. Cl. ..... 335/35; 335/37; 337/71

[51] Int. Cl.[2] ..... H01H 73/12

[58] Field of Search ..... 335/38, 37, 35, 42, 44, 335/45, 170, 171, 174, 176; 337/70, 71

[56] References Cited

UNITED STATES PATENTS

| | | | |
|---|---|---|---|
| 2,619,561 | 11/1952 | Swingle | 337/71 X |
| 2,902,560 | 9/1959 | Stanback et al. | 335/44 X |
| 3,213,249 | 10/1965 | Ellsworth et al. | 335/37 |
| 3,278,707 | 10/1966 | Klein | 335/35 X |
| 3,278,708 | 10/1966 | Casey et al. | 335/35 X |

*Primary Examiner*—G. Harris
*Attorney, Agent, or Firm*—W. A. Elchik

[57] ABSTRACT

A circuit breaker comprises improved thermal and electromagnetic trip means comprising a currrent carrying bimetal operable upon the occurrence of lesser overloads to effect time-delay thermal tripping operations, and electromagnetic means energized by the current in said bimetal which electromagnetic means is operable upon the occurrence of more severe overloads to effect instantaneous electromagnetic tripping operations.

9 Claims, 4 Drawing Figures

CIRCUIT BREAKER WITH IMPROVED TRIP MEANS

CROSS-REFERENCE TO RELATED APPLICATION

The invention disclosed and claimed herein was filed upon in South Africa on Nov. 14, 1972, application No. 72/8079 with Nov. 9, 1973 being the date of filing of the complete specification.

BACKGROUND OF THE INVENTION

1. Field of the Invention

Circuit breakers of the type comprising thermal trip means for time-delayed thermal tripping operations and electromagnetic trip means for instantaneous electromagnetic tripping operations.

2. Description of the Prior Art

A circuit breaker of the general type herein-disclosed is disclosed and claimed in the patent to F. L. Gelzheiser et al U.S. Pat. No. 3,178,535 issued Apr. 13, 1965.

SUMMARY OF THE INVENTION

This invention relates to trip means for circuit breakers of the type comprising relatively movable contacts; operating means for opening and closing the contacts, the operating means being adapted to be retained releasably in a cocked condition with the contacts closed and upon release automatically to cause opening of the contacts; and trip means for releasing the operating means.

It is known to provide trip means comprising a thermally sensitive bi-metallic element; a magnetic pole piece fast with the bi-metallic element; and a trip member pivotally mounted on or adjacent the bi-metallic element and adapted to latch with the operating means of the circuit breaker to retain it in its cocked condition, the trip member also constituting an armature adapted to be attracted electromagnetically by the pole piece with a quick response action to release the operating means upon occurrence of an overload current in excess of a predetermined value, the bi-metallic element being adapted to move upon occurrence of a persistent overload current below the predetermined value to displace the trip member with a delayed response action to release the operating means.

It is normal for the electro-magnetic part of the trip means to provide quick response overload protection when short circuit current or overload current several times normal rated current flows and for the bi-metallic element to provide delayed response overload protection when persistent overload currents of smaller magnitude occur.

Trip means as defined above suffers from the disadvantage that it is difficult to set accurately devices produced in quantity to operate consistently and reliably within narrow limits of quick response tripping at predetermined overload currents and to maintain this setting throughout the range of deflection of the bi-metallic element. It is accordingly an object of the present invention to provide new and improved trip means with which such disadvantages are minimized.

According to the invention trip means suitable for an electric circuit breaker of the type specified includes a movable trip member adapted to latch with the operating means of the circuit breaker to retain it in its cocked condition; a magnetic pole piece; and an armature, the pole piece and the armature being relatively attractable electro-magnetically towards each other upon occurrence of overload current in excess of a predetermined magnitude, thereby to cause displacement of the trip member to release the operating means.

Preferably, the armature is movably mounted and is adapted to be attracted towards the pole piece upon occurrence of overload current in excess of the predetermined magnitude to cause displacement of the trip member to release the operating means.

The armature may be adapted to act directly or indirectly on the trip member.

The armature may have any suitable shape and may be mounted in any suitable manner depending on the current value at which it is required to cause release of the operating means.

The armature may be pivotally mounted.

The armature may be pivotally mounted on the trip member or a part on the trip member.

Preferably, the armature is adapted to have a suitably located fulcrum so that it acts as a lever upon attraction towards the pole piece. The fulcrum is preferably located to give a mechanical advantage.

Any suitable magnetic pole piece may be provided depending on the current value at which the operating means is required to be released.

For relatively low release currents, the pole piece may comprise a soft iron core carrying an energizing winding. The pole piece is preferably substantially U-shaped to present a pair of pole pieces at the free ends of the arms of the U with the pole pieces facing the armature.

For higher release currents, the pole piece may comprise a magnet. The magnet may be in the form of a flat strip.

The pole piece may be mounted on a thermally sensitive, bi-metallic current conductor element adapted to be connected in circuit with the contacts of the circuit breaker, the current conductor element being adapted to move upon occurrence of persistent overload current below the predetermined value to cause displacement of the trip member to release the operating means.

The current conductor element may be adapted to act directly or indirectly on the trip member to cause displacement thereof. The current conductor element may act indirectly on the trip member through the armature.

The armature may be movably mounted on an extension means which is a temperature compensating element fast with the trip member and associated with the current conductor element to render release of the operating means under the influence of the current conductor element substantially independent of ambient temperature conditions.

The temperature compensating element may also comprise a thermally sensitive bi-metallic element.

The armature may be pivotally mounted on the temperature compensating element and may be adapted to fulcrum intermediate its ends against the current conductor element or a part fast therewith. With this arrangement, the current conductor element is adapted to act indirectly on the trip member through the armature and the temperature compensating element.

DESCRIPTION OF THE PREFERRED EMBODIMENTS

Figure 1:
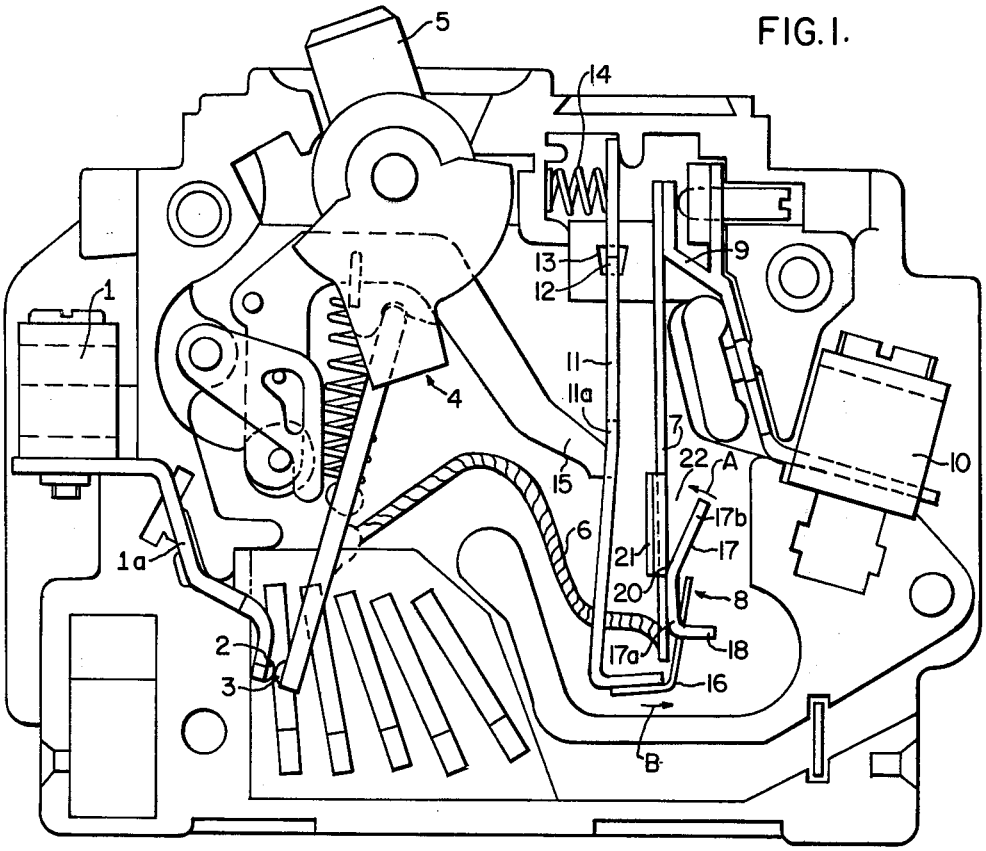
FIG. 1 is a side view (with an end cover removed) of a circuit breaker of the type specified incorporating trip means according to the invention, showing the contacts closed and the operating means latched in cocked condition.
Figure 2:
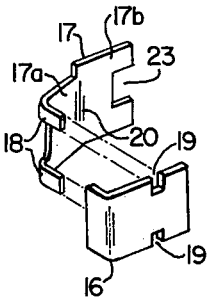
FIG. 2 is an exploded perspective view of the armature and ambient temperature compensating element of the trip means of FIG. 1.

Referring to FIGS. 1 and 2 of the drawings, the circuit breaker is generally of conventional design and comprises external terminal 1 which is electrically connected by conductor 1*a* to stationary contact 2 which is associated with movable contact 3 which is mounted for movement between the closed position shown and an open position. Movable contact 3 is operatively connected mechanically to operating means 4 which is provided with handle 5 and is adapted to effect opening and closing of movable contact 3 in well known manner.

Movable contact 3 is electrically connected by flexible lead 6 to the free end of thermally sensitive, bi-metallic current conductor element 7 of trip means 8. The opposite end of conductor element 7 is fast with and is electrically connected with conductor 9 which is electrically connected to external terminal 10. It will be appreciated that conductor element 7 is connected in circuit with contacts 2, 3 and carries the current flowing between external terminals 1, 10 through contacts 2, 3 when they are closed.

Pole piece 21 which comprises a magnet in strip form is fast with conductor element 7.

Trip means 8 further comprises trip member 11 which is pivotally mounted by means of transverse trunnions 12 thereon which are pivotally received in sockets 13 in the end plates of the circuit breaker. Spring 14 biases trip member 11 for rotation about trunnions 12 towards the latching position shown in FIG. 1 in which releasable member 15 of operating means 4, engages in an aperture 11*a* in trip member 11, thereby to retain the operating means in its cocked condition with breaker contacts 2, 3 closed.

So far the circuit breaker is conventional.

According to the invention, an extension means which is a thermally sensitive bi-metallic temperature compensating element 16 is fast with the lower end of trip member 11 and pivotally mounts armature 17. As will be clear from FIG. 2, armature 17 presents flange-like bifurcations 18 adapted to be pivotally received in notches 19 in temperature compensating element 16. The portion 17*a* of armature 17 located adjacent bifurcations 18, is adapted normally to lie face to face with conductor element 7 in a position of rest as shown in FIG. 1. At 20 armature 17 is bent outwardly away from conductor element 7 to present a fulcrum against conductor element 7 and a portion 17*b* which is attractable towards pole piece 21 on conductor element 7.

When current flows through the circuit breaker and thus through current conductor element 7, magnetic flux is created round conductor element 7. This flux passes through magnet 21, across airgap 22 and through armature portion 17*b*. When short circuit current or a smaller overload current in excess of a predetermined value which is in the order of several times normal rated current, flows through conductor element 7, armature portion 17*b* is attracted electro-magnetically towards magnet 21 so that armature 17 pivots with a lever action in the direction of arrow A relative to temperature compensating element 16 and also relative to conductor element 7 about fulcrum 20. When armature 17 pivots in this manner, it urges temperature compensating element 16 and trip member 11 in the direction of arrow B, thereby to disengage trip member 11 from latch member 15 and release operating means 4 to permit it automatically to cause opening movement of movable contact 3. A quick response magnetic tripping action is obtained.

By suitably locating the fulcrum 20 along armature 17 a mechanical advantage can be obtained when the armature pivots.

When a persistent overload current which is less than the predetermined value occurs, the bi-metallic conductor element 7 is heated and deflects in the direction of arrow B. As bi-metallic conductor element 7 deflects in the direction of arrow B, it exerts pressure through armature 17 on temperature compensating element to cause displacement of trip member 11 and release of the releasable member 15. A time delayed thermal tripping action is obtained.

Bi-metallic conductor element 7 may deflect under the influence of variations of ambient temperature and in order to minimize the effect of such deflection on the tripping action, bi-metallic ambient temperature compensating element 16 is provided to deflect in sympathy with conductor element 7 under the influence of variations of ambient temperature, so that disengagement of trip member 11 from releasable member 15 is substantially independent of ambient temperature conditions. Temperature compensating element 16 is not affected by current flow through conductor element 7 and flexible lead 6.

It will be appreciated that many variations in detail are possible without departing from the scope of the attached claims. Thus, instead of using armature 17 with a cut-out 23 as shown in FIG. 2, the armature 17 of FIG. 3 having a similar shape but without the cut-out 23, may be used to provide a different electro-magnetic tripping current value.

Figure 3:
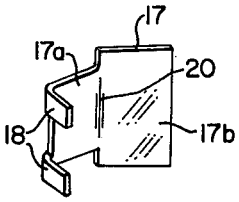
FIG. 3 is a perspective view of an alternative form of armature.
Figure 4:
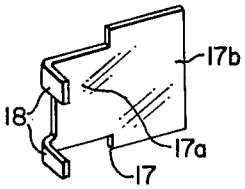
FIG. 4 is a perspective view of yet another form of armature.

The armature 17 of FIG. 4 is generally of the same shape as the armature of FIG. 3, but the portions 17*a*, 17*b* lie in substantially the same plane. The armature 17 of FIG. 4 may be used with a magnetic pole piece (not shown) comprising a substantially U-shaped soft iron core adapted to carry an energizing winding connectable in series circuit between the free end of conductor element 7 and the flexible lead 6. This arrangement is suitable for use in conjunction with an electro-magnetic tripping current value which is less than that obtained with the armatures of FIGS. 2 and 3 when used in conjunction with plate-like magnetic pole pieces.

Tripping means according to the invention improves the efficiency and consistency of performance of circuit breakers. Due to the lever action of a pivotally mounted armature 17 and the mechanical advantage that can be obtained, improved efficiency of operation can be obtained.

It will be seen from FIG. 1 that armature 17 contacts conductor element 7 at fulcrum 20 so that there is only one airgap 22 between conductor element 7 and armature portion 17*b*. The reluctance of the flux path can thus be decreased and the tripping efficiency increased.

The angle of armature 17 at fulcrum 20, the relative lengths of portions 17*a*, 17*b* on opposite sides of fulcrum 20 and the configuration of portion 17*b* of armature 17 control the electromagnetic tripping current value. It is relatively easy to vary the angle at fulcrum 20 for the purpose of setting the tripping current value. It is possible to set the tripping current value of circuit breakers which are produced in quantity and which incorporate trip means according to the invention, to relatively fine tolerances so that there is no substantial difference in the current value at which different breakers of the same magnetic tripping current rating will trip electro-magnetically.

It is common practice in reticulation systems to provide circuit breakers having different magnetic tripping current ratings in order to obtain selective tripping of circuit breakers in response to fault currents of different magnitudes. Because of the accuracy and consistency of performance obtainable with trip means according to the invention, better discrimination between fault currents of different levels can be obtained.

The invention includes within its scope a circuit breaker incorporating trip means according to the invention as disclosed above.

What we claim is:

1. A circuit breaker comprising relatively movable contacts and releasable means releasable to effect automatic opening of said contacts, trip means comprising an elongated current carrying bimetal supported in proximity to one end thereof, a magnetic pole-piece supported on said bimetal, a movable trip member positioned on one side of said bimetal and latching said releasable means, a magnetic armature, support means supporting said armature for movement on the side of said bimetal opposite said one side, extension means operatively connecting said trip member with said bimetal and operatively connecting said trip member with said armature, upon the occurrence of an overload below a predetermined value said bimetal flexing and operating through said extension means to move said trip member to release said releasable means, and upon the occurrence of an overload above said predetermined value said armature being attracted to said magnetic pole piece and operating through said extension means to move said trip member to release said releasable means.

2. A circuit breaker according to claim 1, and said armature being movably supported on said extension means.

3. A circuit breaker according to claim 2, and said armature being pivotally supported on said extension means.

4. A circuit breaker according to claim 1, said extension means being supported on said trip member and extending from said one side to said opposite side of said bimetal, and said armature being movably supported on said extension means on said opposite side of said bimetal.

5. A circuit breaker according to claim 4, and said armature being pivotally supported on said extension means.

6. A circuit breaker according to claim 1, and said extension means comprising a compensating bimetal.

7. A circuit breaker according to claim 6, and said armature being movably supported on said extension means.

8. A circuit breaker according to claim 7, and said armature being pivotally supported on said extension means.

9. A circuit breaker according to claim 8, said extension means being supported on said trip member and extending from said one side to said opposite side of said bimetal, and said armature being movably supported on said extension means on said opposite side of said bimetal.

* * * * *